US008483395B2

(12) United States Patent
Yoo et al.

(10) Patent No.: US 8,483,395 B2
(45) Date of Patent: Jul. 9, 2013

(54) SOUND FIELD REPRODUCTION APPARATUS AND METHOD FOR REPRODUCING REFLECTIONS

(75) Inventors: Jae-Hyoun Yoo, Daejon (KR); Hwan Shim, Seoul (KR); Hyunjoo Chung, Seoul (KR); Jun-Seok Lim, Seoul (KR); Tae-Jin Lee, Daejon (KR); Dae-Young Jang, Daejon (KR); Koeng-Mo Sung, Seoul (KR); Kyeongok Kang, Daejon (KR); Jin-Woo Hong, Daejon (KR); Jin-Woong Kim, Daejon (KR); Chieteuk Ahn, Daejon (KR)

(73) Assignee: Electronics and Telecommunications Research Institute, Daejon (KR)

( * ) Notice: Subject to any disclaimer, the term of this patent is extended or adjusted under 35 U.S.C. 154(b) by 1118 days.

(21) Appl. No.: 12/113,311

(22) Filed: May 1, 2008

(65) Prior Publication Data

US 2008/0279389 A1 Nov. 13, 2008

(30) Foreign Application Priority Data

May 4, 2007 (KR) ..... 10-2007-0043707
Nov. 30, 2007 (KR) ..... 10-2007-0123491

(51) Int. Cl.
*H04R 5/00* (2006.01)
*H04R 25/00* (2006.01)

(52) U.S. Cl.
USPC ..... 381/17; 381/18; 381/300; 381/306; 381/310

(58) Field of Classification Search
USPC 381/17, 18, 23, 60, 61; 700/94; 704/E19.005
See application file for complete search history.

(56) References Cited

U.S. PATENT DOCUMENTS

| | | | | |
|---|---|---|---|---|
| 2002/0048380 | A1 | 4/2002 | McGrath | |
| 2003/0007648 | A1 * | 1/2003 | Currell | 381/61 |
| 2008/0165979 | A1 * | 7/2008 | Takumai | 381/59 |

FOREIGN PATENT DOCUMENTS

| | | | |
|---|---|---|---|
| JP | 2003-271135 | A | 9/2003 |
| KR | 1993-0005559 | U | 3/1993 |
| KR | 1020000047558 | A | 7/2000 |
| KR | 1020050013323 | | 2/2005 |
| KR | 1020060052164 | | 5/2006 |

OTHER PUBLICATIONS

Hyunjoo Chung; "Hybrid Sound Field Processing for Wave Field Synthesis System", Audio Engineering Society Convention Paper 7069, Presented at the 122nd Convention May 5-8, 2007, Vienna, Austria; 5 pages.

* cited by examiner

*Primary Examiner* — Lynne Gurley
*Assistant Examiner* — Vernon P Webb
(74) *Attorney, Agent, or Firm* — Ladas & Parry LLP

(57) ABSTRACT

Provided are sound field reproducing apparatus and method. The sound field reproducing apparatus includes an input unit for receiving reflection reproducing information, a signal processor for selecting loudspeakers and calculating reflection signal for applying a panning algorithm based on the reflection reproducing information, a signal treatment unit for localizing the calculated reflection signal on a virtual sound image according to the panning algorithm; and a reproducer for reproducing the localized reflection signals through the selected loudspeakers.

22 Claims, 16 Drawing Sheets

SOUND FIELD REPRODUCTION APPARATUS AND METHOD FOR REPRODUCING REFLECTIONS

CROSS-REFERENCES TO RELATED APPLICATIONS

The present invention claims priority of Korean Patent Application Nos. 10-2007-0043707 and 10-2007-0123491, filed on May 4, 2007, and Nov. 30, 2007, respectively, which are incorporated herein by reference.

BACKGROUND OF THE INVENTION

1. Field of the Invention

The present invention relates to sound field reproducing apparatus and method for reproducing reflections and, more particularly, to sound field reproducing apparatus and method for reproducing reflections to provide realistic presence and space perception to audiences by reproducing reflections using a panning algorithm or reproducing reflections using each of loudspeakers while reproducing not only a direct sound but also the reflect sources in a surround sound field through multichannel loudspeakers.

This work was supported by the IT R&D program of MIC/IITA [2007-S-004-01, "Development of Glassless Single-User 3D Broadcasting Technologies"].

2. Description of Related Art

Three dimensional (3-D) sound source reproduction technologies have been advanced from stereophony to discrete surround, binaural reproduction, or transaural reproduction. Although sound source reproduction schemes such as 2 channel stereo, 5.1 channel surround, or 7.1 channel surround, provide a sound image that enables audiences to have 3-D effect, these schemes have shortcoming of a limited listening sweet spot.

In order to overcome such a shortcoming, a wave field synthesis (WFS) reproduction technology was introduced. The WFS reproduction technology is a technology for reproducing not only a spherical wave sound field but also a plane wave sound field. Also, the WFS reproduction technology has many advantages, for example, reproducing a moving sound source and forming a virtual sound source any locations in a listening area. Therefore, the WFS reproduction technology has been receiving attention as next generation audio reproduction technology.

In 3-D sound source reproduction technology, processing sound field is one of important parts for providing realistic space perception and presence to audiences. For example, an artificial reverberator, a sound field reproducing device, processes such a signal that gives realistic space perception and presence to audiences. It is an object of the sound field reproducer to change a sound environment in a listening room to a desired sound environment for audiences. But, a sound environment of home may be partly compensated through a sound field tuning system.

However, it is necessary to process a sound field signal to artificially form an optimal sound environment according to a sound source. Such a sound field reproducing technology must employ a signal processing scheme different from that of the reverberator. Most of sound sources include reverberation components. If reverberation is input to a sound field reproducer, reverberation time is lengthened because reverberation overlaps in a sound source. Therefore, a sound tone is distorted.

In case of a movie sound source, new approach is required for processing a sound field thereof because a sound field effect is maximized by controlling frequency characteristics, instead of reverberation, according to movie genres. Therefore, a sound field reproduction technology for home theater depends on experience and artistry, not theory.

Currently, there is no standard introduced for an optimal reproducing apparatus or for recording, which can be applied to a wave field synthesis reproducing environment. It is essential to reproduce a surround sound field recording sound source in a wave field synthesis reproducing environment in a view of backward compatibility. That is, a sound field reproducing function is essentially required to change a desired sound environment for audiences.

In order to satisfy such a requirement, many researches have been made for realizing virtual sound image localization by reproducing only direct sound based on a wave field synthesis rendering scheme. A sound field reproducing scheme according to the related art does not perform signal processing or reproduces additionally obtained audio as it is. For example, a sound reproducing system according to the related art introduced by a 'Delft' university records each of sound sources with almost no echo through spot microphones in a recording studio. Then, the sound reproducing system localizes the recorded sound sources at predetermined locations as virtual sound sources through a wave field synthesis rendering method at a reproducing end. The sound reproducing system records reverberation and reflections in a recording studio through stereo microphones and renders the recorded sounds as virtual stereo sound sources farther away therefrom.

However, according to the sound reproducing technology, a complete wave field synthesis reproducing system only can be realized through a wave field synthesis rendering and direct recording anechoic sound sources. That is, the sound reproducing technology according to the related art cannot embody a complete wave field synthesis reproducing system through other sound source.

Particularly, a wave field synthesis reproducing technology using a multichannel loudspeaker array considers all of sound sources to reproduce as point sources. Such a wave field synthesis reproducing technology produces audio by processing signals using information about a reproducing direction, a time, and a size of sound sources for an audience location.

In order to reproduce a sound source in a predetermined space, it is necessary to reproduce not only a direct sound of the sound source but also reflections generated from walls, floors, and ceiling for providing realistic audio to audiences. That is, if a wave field synthesis reproduction method is used for processing the reflections as well as for the direct sound, it is possible to provide further realistic the presence and the space perception to audience.

However, there may be about several thousands to ten thousands of reflections that characterize a predetermined space. Therefore, if all of reflections are processed through the wave field synthesis reproduction method, computation amount and time increase. That is, the wave field synthesis reproduction technology using a multichannel loudspeaker array according to the related art has difficulties to process reflections through the wave field synthesis reproduction method. Thus, the wave field synthesis reproduction technology cannot maximize presence and space perception.

SUMMARY OF THE INVENTION

An embodiment of the present invention is directed to providing sound field reproducing apparatus and method for reproducing reflections to provide realistic presence and space perception to audiences by reproducing reflections using a panning algorithm or reproducing reflections using each of loudspeakers while reproducing not only a direct sound but also the reflect sources in a surround sound field through multichannel loudspeakers.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with an aspect of the present invention, there is provided a surround sound field reproducing apparatus, including: an input unit for receiving reflection reproducing information; a signal processing unit for selecting loudspeakers and calculating reflection signal for applying a panning algorithm based on the reflection reproducing information; a signal treatment unit for localizing the calculated reflection signal on a virtual sound image according to the panning algorithm; and a reproducing unit for reproducing the localized reflection signals through the selected loudspeakers.

In accordance with another aspect of the present invention, there is provided a surround sound field reproducing apparatus, including: an input unit for receiving reflection reproducing information; a signal treatment unit for confirming loudspeakers corresponding to reflection reproducing angles based on the received reflection reproducing information and controlling spatial impulse responses of reflections according to the confirmed loudspeakers; a signal processing unit for calculating reflection signal from the controlled spatial impulse responses and a sound source signal of a direct sound; and a reproducing unit for reproducing the calculated reflection signal through the confirmed loudspeakers.

In accordance with still another aspect of the present invention, there is provided a surround sound field reproducing method, including the steps of: receiving reflection reproducing information; selecting loudspeakers and calculating reflection signal for applying a panning algorithm based on the reflection reproducing information; localizing the calculated reflection signal on a virtual sound image according to the panning algorithm; and reproducing the localized reflection signals through the selected loudspeakers.

In accordance with further another aspect of the present invention, there is provided a surround sound field reproducing method, including the steps of: receiving reflection reproducing information; confirming loudspeakers corresponding to reflection reproducing angles based on the received reflection reproducing information and controlling spatial impulse responses of reflections according to the confirmed loudspeakers; calculating reflection signal from the controlled spatial impulse responses and a sound source signal of a direct sound; and reproducing the calculated reflection signal through the confirmed loudspeakers.

BRIEF DESCRIPTION OF THE DRAWINGS

FIGS. 15 to 17 are diagrams illustrating loudspeaker arrangements where the second embodiment of the present invention is applied to.

DESCRIPTION OF SPECIFIC EMBODIMENTS

The advantages, features and aspects of the invention will become apparent from the following description of the embodiments with reference to the accompanying drawings, which is set forth hereinafter. Therefore, those skilled in the field of this art of the present invention can embody the technological concept and scope of the invention easily. In addition, if it is considered that detailed description on a related art may obscure the points of the present invention, the detailed description will not be provided herein. The preferred embodiments of the present invention will be described in detail hereinafter with reference to the attached drawings.

Figure 1:
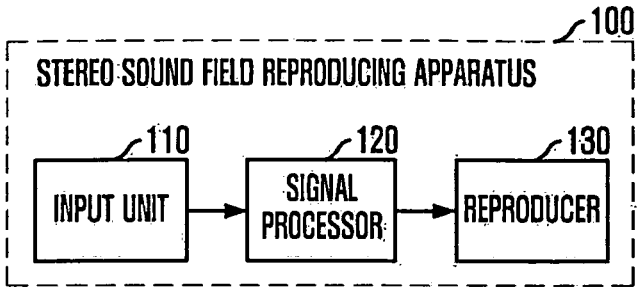
FIG. 1 is a diagram illustrating a surround sound field reproducing apparatus using wave field synthesis.

FIG. 1 is a diagram illustrating a surround sound field reproducing apparatus using wave field synthesis.

As shown in FIG. 1, the surround sound field reproducing apparatus 100 includes an input unit 110, a signal processor 120, and a reproducer 130.

Hereinafter, the constituent elements of the surround sound field reproducing apparatus 100 will be described.

The input unit 110 receives loudspeaker arrangement information, sound source location information, and a sound source signal for localizing a sound source. For example, the loudspeaker arrangement information includes information about a location of a loudspeaker array and a distance between loudspeakers. The sound source location information includes information about an angle of a sound source from a listening location.

The signal processor 120 calculates distances from each of loudspeakers to a sound source location from the received loudspeaker arrangement information and calculates a sound pressure signal in an impulse response form by applying the calculated distance to a loudspeaker driving function. That is, the signal processor 120 calculates a sound pressure signal (sound) to be emitted by applying the loudspeaker arrangement information and the sound source location information to Eq. 1, the loudspeaker driving function. Then, the signal processor 120 calculates sound pressure signals of each loudspeaker in a form of impulse response in consideration of delay and gain.

$$Q(\vec{r}_n, \omega) = S(\omega)\sqrt{\frac{|z-z_1|}{|z-z_0|}}\,\frac{\cos(\theta_n)}{G_n(\theta_n, \omega)}\sqrt{\frac{jk}{2\pi}}\,\frac{e^{-jk|\vec{r}_n-\vec{r}_m|}}{\sqrt{|\vec{r}_n-\vec{r}_m|}} \quad \text{Eq. 1}$$

In Eq. 1, $Q(\vec{r}_n,\omega)$ denotes an audio signal driving function for an audio signal emitted from the $n^{th}$ loudspeaker among loudspeakers forming an array. $S(\omega)$ denotes a virtual sound source.

$$\sqrt{\frac{|z-z_1|}{|z-z_0|}}$$

is a weight for a size. $G_n(\theta_n,\omega)$ denotes a directivity of each loudspeaker, that is, component weighting sound pressure. $\cos(\theta_n)$ is a ratio a virtual sound source for a vertical direction and a distance to a $n^{th}$ loudspeaker.

$$\sqrt{\frac{jk}{2\pi}}$$

denotes radio frequency amplification equalizing, $e^{-jk|\vec{r}_n-\vec{r}_m|}$ denotes a delay time generated by a distance between a virtual sound source and a $n^{th}$ loudspeaker. Since loudspeakers are arranged linearly, it is assumed that a virtual sound source is a linear sound source. In this case, $$\frac{1}{\sqrt{|\vec{r}_n-\vec{r}_m|}}$$

denotes diffusion of one cylindrical wave.

Eq. 1 relates to a sound source rendering thesis using wave field synthesis based on Huygens's principle and Kirchhoff-Helmholtz integral. The sound source rendering thesis relates to a speaker driving function for calculating sounds for each of loudspeaker by distinguishing an area where a virtual sound source is reproduced through the Rayleigh's representation theorem from an area where n physical loudspeaker arrays emit sound.

The signal processor 120 performs Fourier Transform on the pressure signal in the impulse response form from Eq. 1. Then, the signal processor 120 generates sound source signals rendered through wave field synthesis scheme as many as the number of loudspeakers. That is, the signal processors 120 calculates driving signals of each loudspeaker by convoluting the sound source signal from the input unit 110 with the Fourier-transformed sound pressure signal. The signal processor 120 perform convolution on a sound source signal and a reflection signal. The signal processor 120 calculates all driving signals for n loudspeakers for defining a vertical location of a sound source signal in a listening space.

The reproducer 130 reproduces the driving signals of each loudspeaker from the signal processor 120 through corresponding loudspeakers among n loudspeakers.

Figure 2:
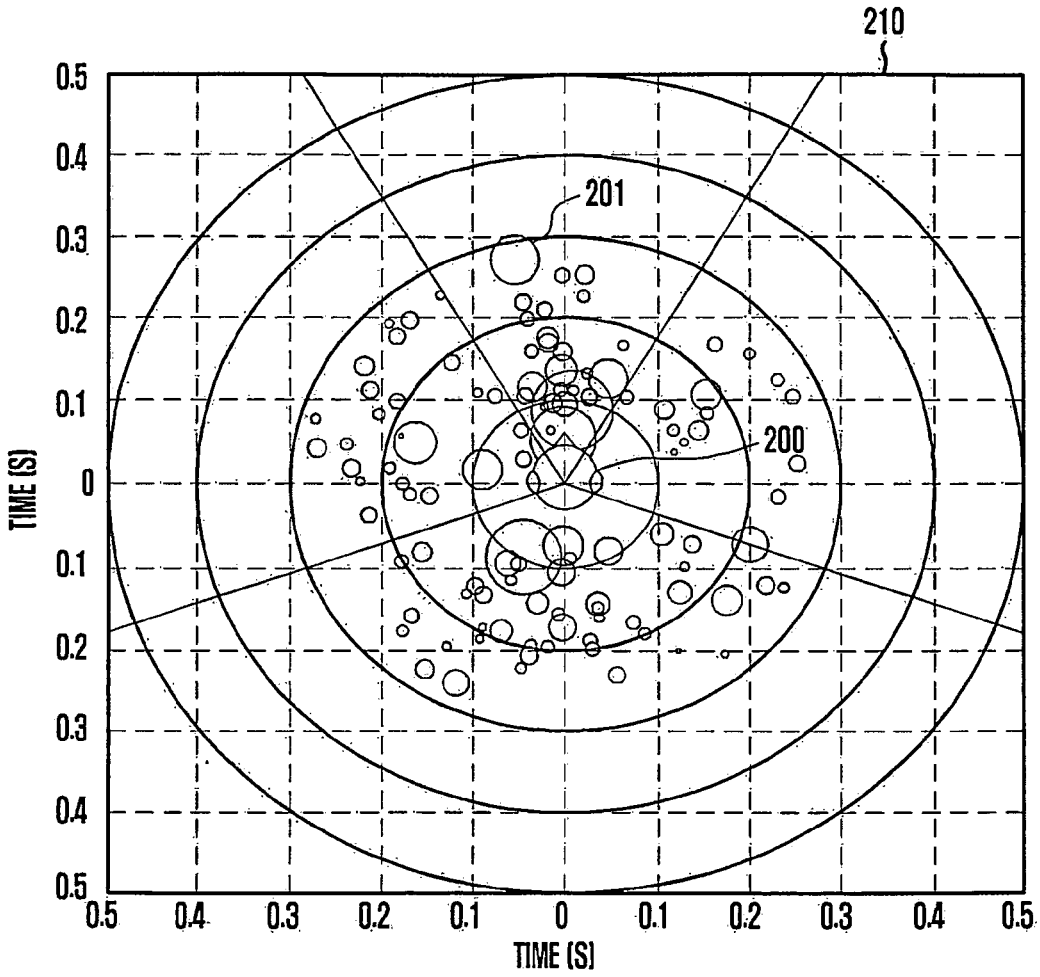
FIG. 2 is a diagram exemplary illustrating reflections distribution in a sound field of a horizontal plane.

FIG. 2 is a diagram exemplary illustrating reflections distribution in a sound field of a horizontal plane.

The surround sound field reproducing apparatus 100 reproduces initial reflections of a space 210. Here, the surround sound field reproducing apparatus 100 can obtain reflections through various microphone arrangements. The surround sound field reproducing apparatus 100 reproduces sounds in a horizontal plane at a height of loudspeakers surrounding an audience 200. Therefore, a vertical plane is not considered. As shown in FIG. 2, the reflections 201 in the sound field of the plane are distributed in all directions around the audience 300.

Figure 3:
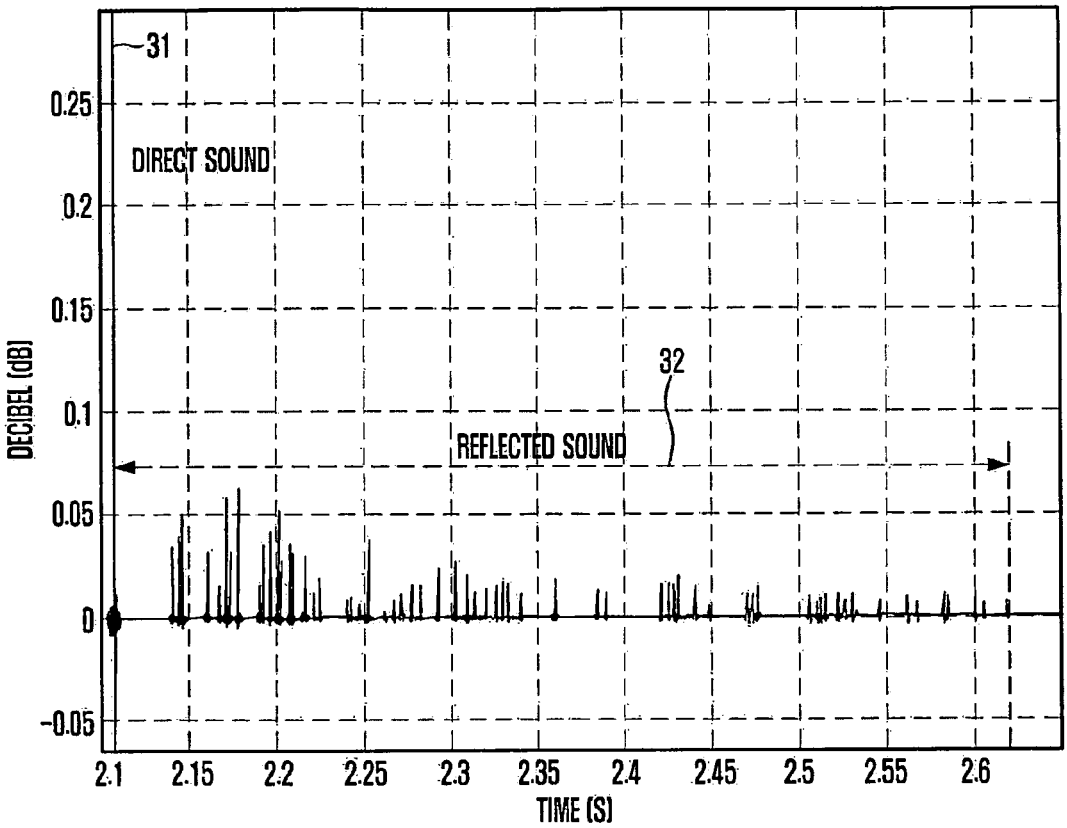
FIG. 3 is a graph comparing a size of a direct sound with that of reflections in time.

FIG. 3 is a graph comparing a size of a direct sound with that of reflections in time.

If the reflections 32, which are distributed in all direction as shown in FIG. 2, are considered as samples to reduced in each of loudspeakers, the sizes of the direct sound 31 and the reflections 32 change in time. Therefore, if all samples are considered as one point source, the surround sound field reproducing apparatus 100 can render not only the direct sound 31 but also the reflections 32 through a wave field synthesis method.

TABLE 1

| Delay [ms] (From direct sound) | Level [dB] (Comparative level for direct sound) | Azimuth [°] (Center listening point) |
|---|---|---|
| 12.1 | −34 | 11 |
| 14.5 | −29 | 75 |
| 15.9 | −28 | 343 |
| 17.2 | −34 | 134 |
| 18.5 | −30 | 207 |
| 19.8 | −42 | 258 |
| 21.0 | −30 | 5 |
| 21.7 | −31 | 306 |
| ... | ... | ... |

Table 1 shows characteristics of reflections 32 shown in FIG. 3. A reflection signal in a predetermined space has information a relay time for reproducing the reflections 32, a sound pressure, and an incline angle based on an audience. The surround sound field reproducing apparatus 100 receives a reflection signal having three information of a predetermined space and performs a wave field synthesis rendering process on the received reflections signal. As a result, the surround sound field reproducing apparatus 100 reproduces each of the reflections 32 considered as point sound sources.

Figure 4:
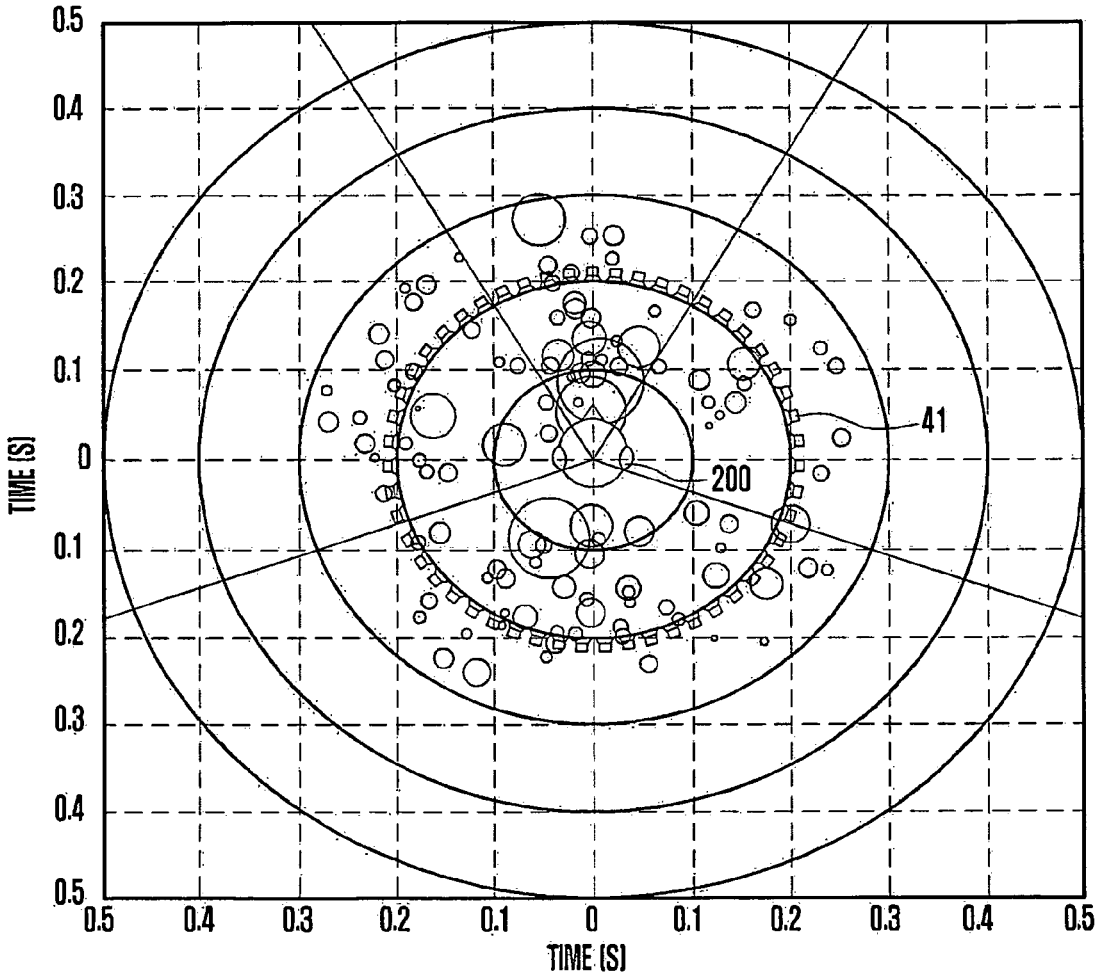
FIGS. 4 to 6 diagrams illustrating loudspeaker arrangement applied to a surround sound field reproducing apparatus using wave field synthesis.
Figure 5:
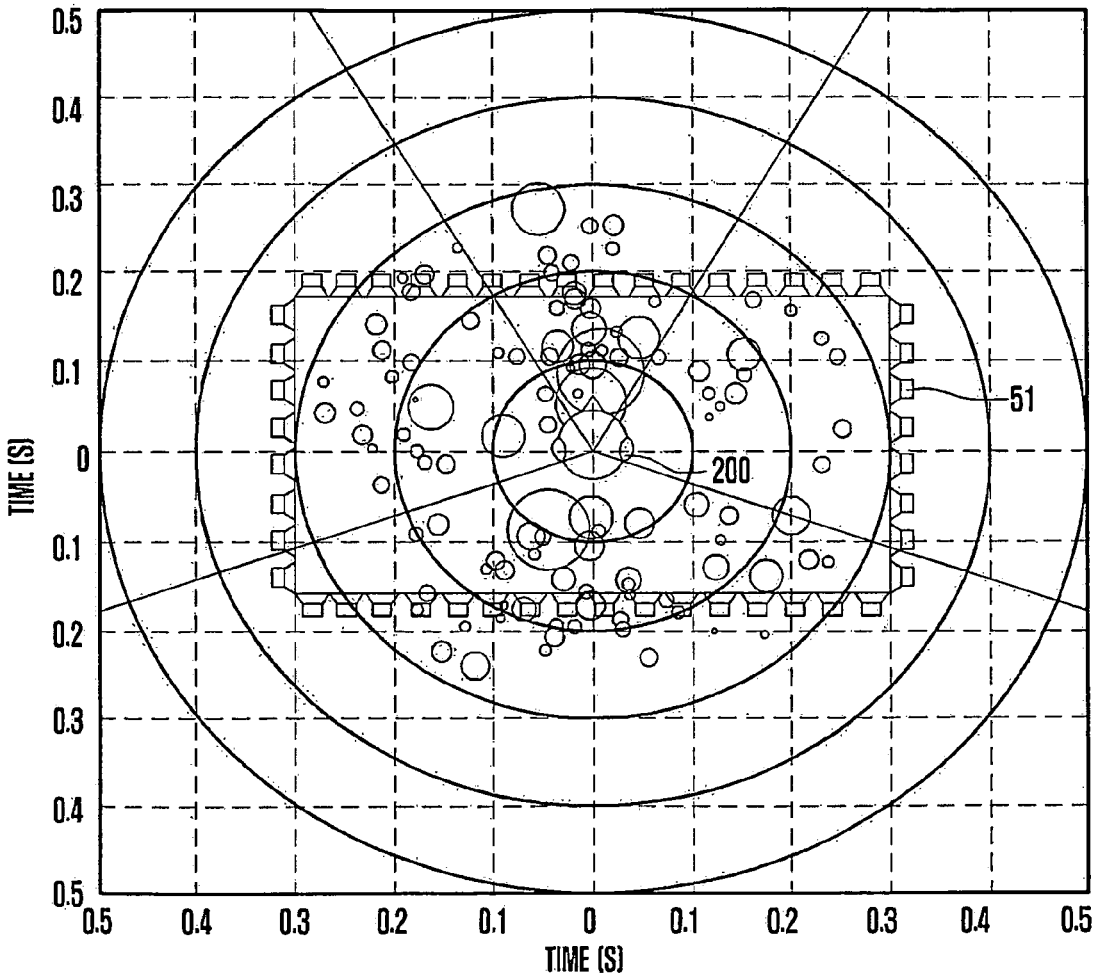
Figure 6:
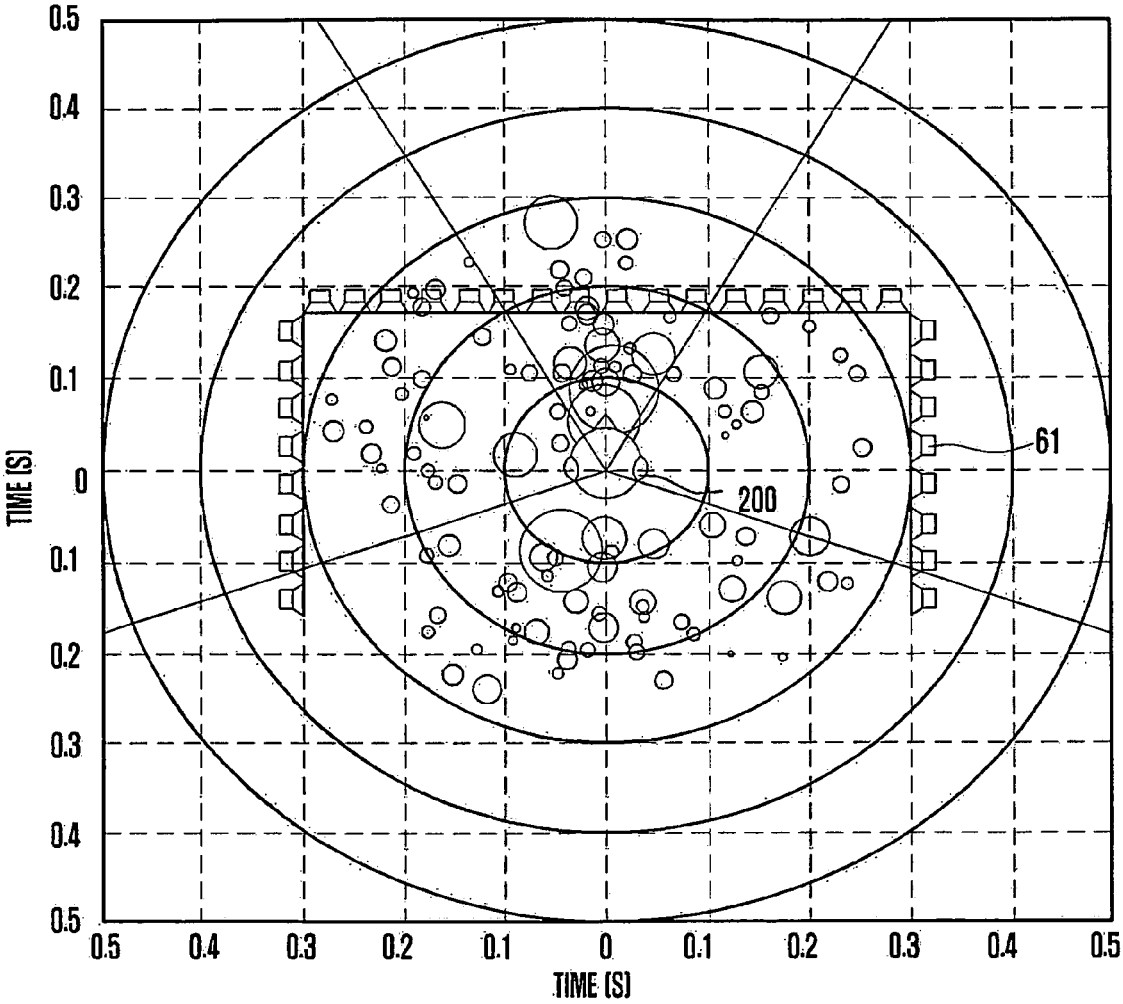

FIGS. 4 to 6 diagrams illustrating loudspeaker arrangement applied to a surround sound field reproducing apparatus using wave field synthesis.

Based on the location of the audience 200, loudspeakers 41, 51, and 61 may be arranged in various ways. As shown in FIGS. 4 to 6, the loudspeakers 41, 51, and 61 may be arranged in circle, in rectangular, or in a form of '⊏'. The signal processor 120 calculates driving signals outputted through n loudspeakers according to such loudspeaker arrangement information.

Figure 7:
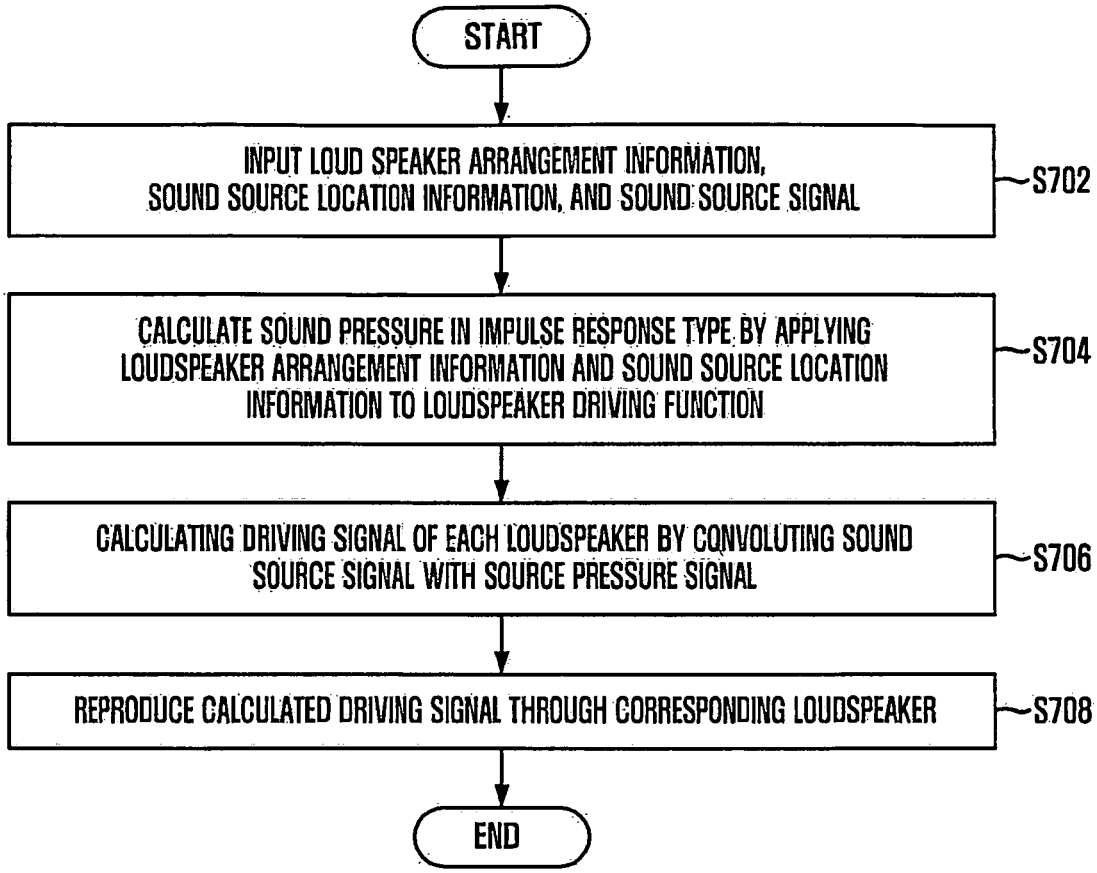
FIG. 7 is a flowchart illustrating a surround sound field reproduction method using wave field synthesis.

FIG. 7 is a flowchart illustrating a surround sound field reproduction method using wave field synthesis.

At first, the input unit 110 receives loudspeaker arrangement information, sound source information, and a sound source signal for localizing a sound source at step S702. Here, the loudspeaker arrangement information includes information about a location of a loudspeaker array and a distance between loudspeakers. The sound source location information includes information about an angle of a sound source from a listening location.

The signal processor 120 calculates a sound pressure signal in an impulse response form by applying the received loudspeaker arrangement information and sound source information to a loudspeaker driving function at step S704. Then, the signal processor 120 transforms the sound pressure signal based on Fourier Transform.

The signal processor 120 calculates driving signals to be output from each of loudspeakers by convoluting the sound source signal from the input unit 110 with the transformed sound pressure signal at step S706.

The reproducer 130 reproduces the driving signals from the signal processor 120 through corresponding loudspeakers among n arranged loudspeakers.

Hereinafter, a surround sound field reproducing apparatus for reproducing reflections according to an embodiment of the present invention will be described with reference to FIGS. 8 to 13. The surround sound field reproducing apparatus according to the first embodiment reproduces reflections formed in 360° omnidirection.

At first, a panning algorithm will be described before describing the surround sound field reproducing apparatus according to the first embodiment.

In order to realistically reproduce reflections of a predetermined space, the surround sound field reproducing apparatus 100 using the wave field synthesis reproduces about 1,000 or 10,000 reflections through n speakers. Therefore, the surround sound field reproducing apparatus 100 performs rendering processes about (1,000~10,000)×n time. As shown in FIG. 2, reflections are made by walls from direct sounds and the reflections propagate toward an audience in 360° omnidirection. The surround sound field reproducing apparatus 100 must perform a plurality of computations for reproducing such a plurality of reflections.

Here, the panning algorithm localizes a virtual sound source through a stereophony reproduction scheme. The panning algorithm arranges a virtual speaker, a virtual sound source, between two physical speakers by controlling the output power of two speakers. Also, the panning algorithm can localize a sound source at any positions between two speakers. If the panning algorithm is applied as described above, reverberation of a predetermined space is realistically reproduced with presence. That is, the reverberation is the characteristic reflection of a sound in a predetermined space. For example, if a singer sings a song in a concert hall, a voice of the singer on a stage, a direct sound, is reflected by four side walls, and audiences listen the reflections from the four side walls in 360° omnidirection as well as the direct sound. The panning algorithm can provide directivities and presence to audiences using such phenomena. That is, the direct sound gives directivities to audiences and the reflections gives presence while enhancing the direct sound.

Figure 8:
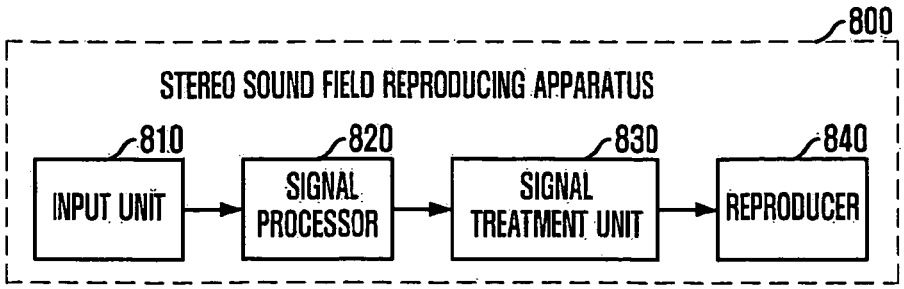
FIG. 8 is a diagram illustrating a surround sound field reproducing apparatus for reproducing reflections according to an embodiment of the present invention.

FIG. 8 is a diagram illustrating a surround sound field reproducing apparatus for reproducing reflections according to an embodiment of the present invention.

Referring to FIG. 8, the surround sound field reproducing apparatus 800 according to the first embodiment includes an input unit 810, a signal processor 820, a signal treatment unit 830, and a reproducer 840.

The input unit 810 receives reflection reproducing information such as information about loudspeaker arrangement, a sound source location of reflections for a target sound source location to localize from an audience, a spatial impulse response of reflections in a predetermined space, and a sound source signal of a direct sound.

The signal processor 820 calculates an angle of each loudspeaker to a location of an audience and a distance from the audience to each loudspeaker by analyzing the sound source location information and the loudspeaker arrangement information. The signal processor 820 selects a plurality of loudspeakers to apply a panning algorithm by confirming angles and distances between the sound source location of the reflections and each loudspeaker. Here, the signal processor 820 may select different loudspeakers according to an arrangement type of loudspeakers in order to apply a panning algorithm.

Figure 10:
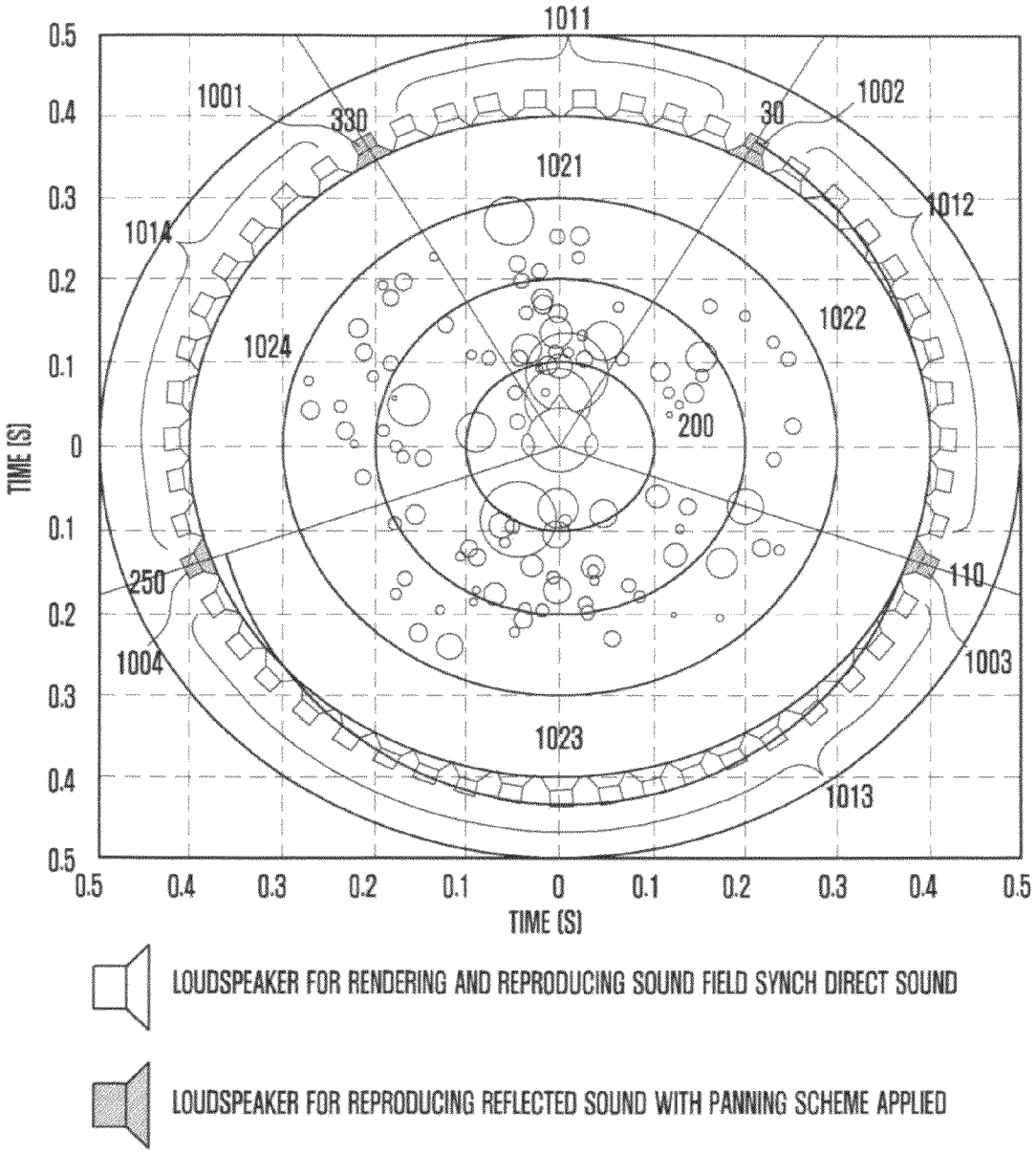
FIGS. 10 to 12 are diagrams illustrating loudspeaker arrangements applied to the first embodiment of the present invention.
Figure 11:
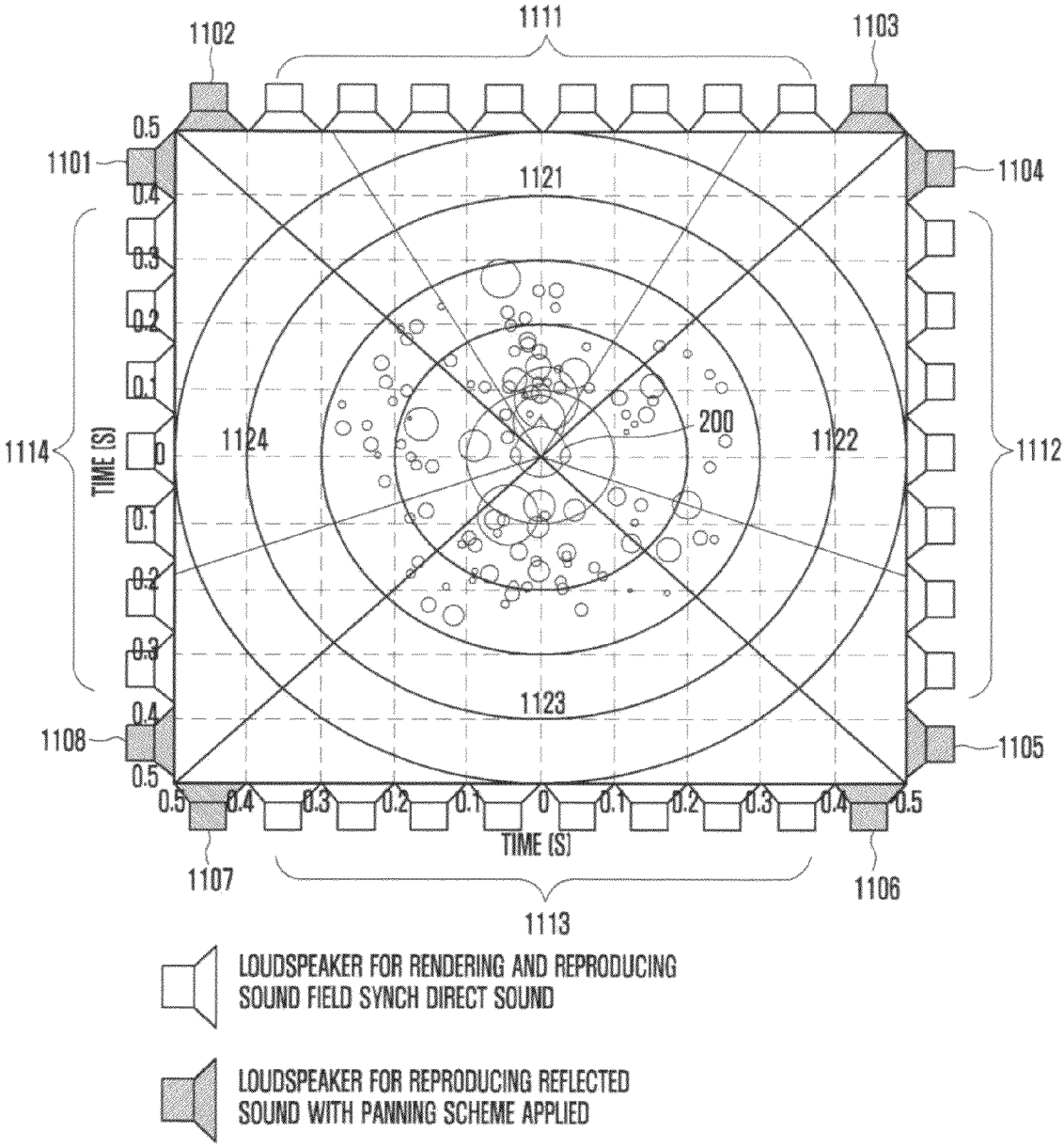

For example, the signal processor 820 selects loudspeakers located at 30°, 110°, 250°, and 330° from a listening location. It is because multichannel loudspeaker arrays are arranged in circle as shown in FIG. 10. If multichannel loudspeaker arrays are linearly arranged as shown in FIG. 11, two loudspeakers are selected from edges of each loudspeaker array. That is, total eight loudspeakers are selected. Also, if loudspeaker arrays are arranged in a form of ⊏, total six loudspeakers are selected. Meanwhile, since loudspeaker arrays may be arranged in various ways such as triangle or diamond, a plurality of loudspeakers are selected according to a corresponding arrangement.

The signal processor 820 calculates reflections by convoluting a spatial impulse response of reflections for a predetermined space and a sound source signal of a direct sound among the reflection reproducing information from the input unit 810.

The signal treatment unit 830 localizes reflections at a virtual sound image by allocating a reflection signal to a pair of loudspeakers through analyzing an angle component of the calculated reflections signal from the signal processor 820. Here, the signal treatment unit 830 localizes reflections at the virtual sound image using Constant Power Panning Law using a pair of loudspeakers and Inverse Square Law for compensating the virtual sound image according to a distance.

That is, the signal treatment unit 830 analyzes the angle information of the calculated reflections signal and allocates a reflection signal to a pair of loudspeakers selected at the signal processor 820 in order to apply the panning algorithm. Here, the reflections signal has angle components corresponding to the front, the sides, and the rear. The constant power panning algorithm is applied through a pair of loudspeakers separated at the same distance from an audience. A virtual sound image formed through the panning algorithm is also located at the same distance. Therefore, if loudspeakers are linearly arranged, a pair of loudspeakers at the edges is farthest away from an audience and remaining loudspeakers are comparatively close to the audience. Therefore, the signal treatment unit 830 localizes a virtual sound image at a location farther away from an audience according to a panning algorithm, which would be localized at a location comparative close to an audience if the inverse square law is used.

The reproducer 840 reproduces the reflection signal localized at the virtual sound image by the signal treatment unit 830 through a pair of loudspeakers.

Figure 9:
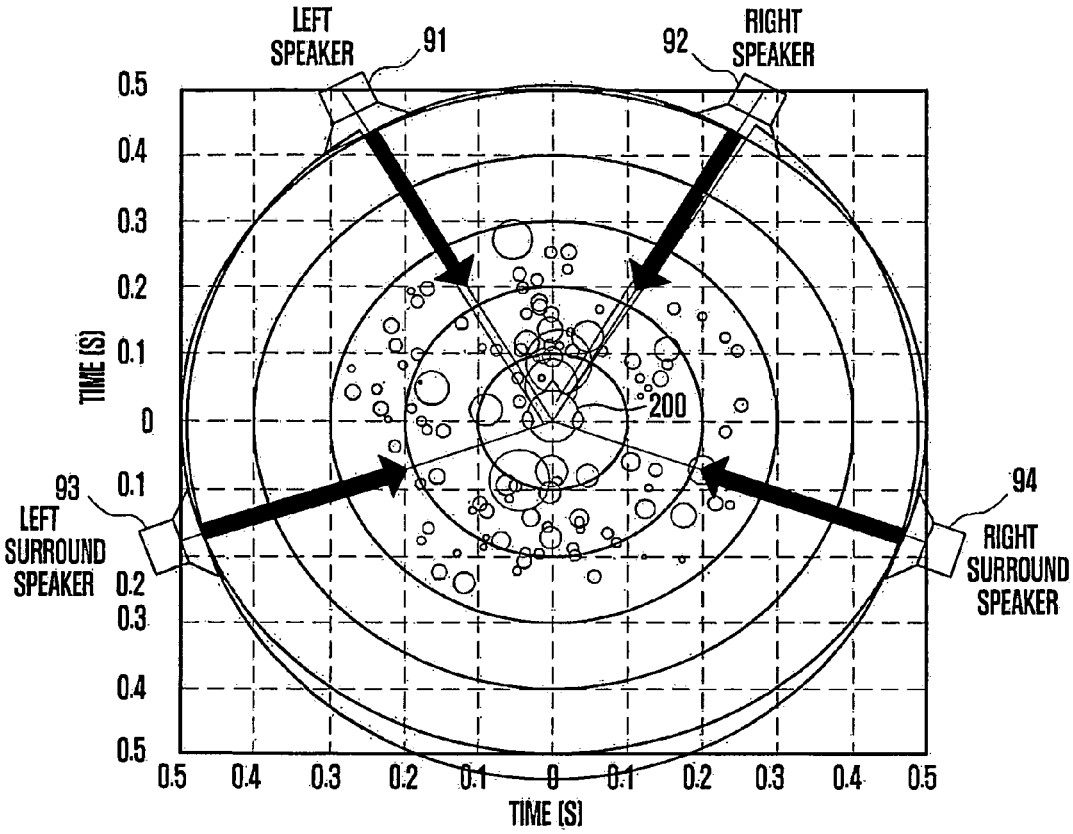
FIG. 9 is a diagram illustrating a panning algorithm applied to the preset invention.

FIG. 9 is a diagram illustrating a panning algorithm applied to the preset invention.

Referring FIG. 9, the panning algorithm is performed using a pair of loudspeakers. The surround sound field reproducing apparatus 800 reproduces reflections for the front through panning between a left speaker 91 and a right speaker 92. Also, the surround sound field reproducing apparatus 800 reproduces the reflections for the sides through panning using a left speaker 91, a left surround speaker 93, a right speaker 92 and a right surround speaker 94. The surround sound field reproducing apparatus 80 reproduces the reflections for the rear through panning using a left surround speaker 93 and a right surround speaker 94. Therefore, the surround sound field reproducing apparatus 800 reproduces reflections generated in 360° omnidirection.

Figure 12:
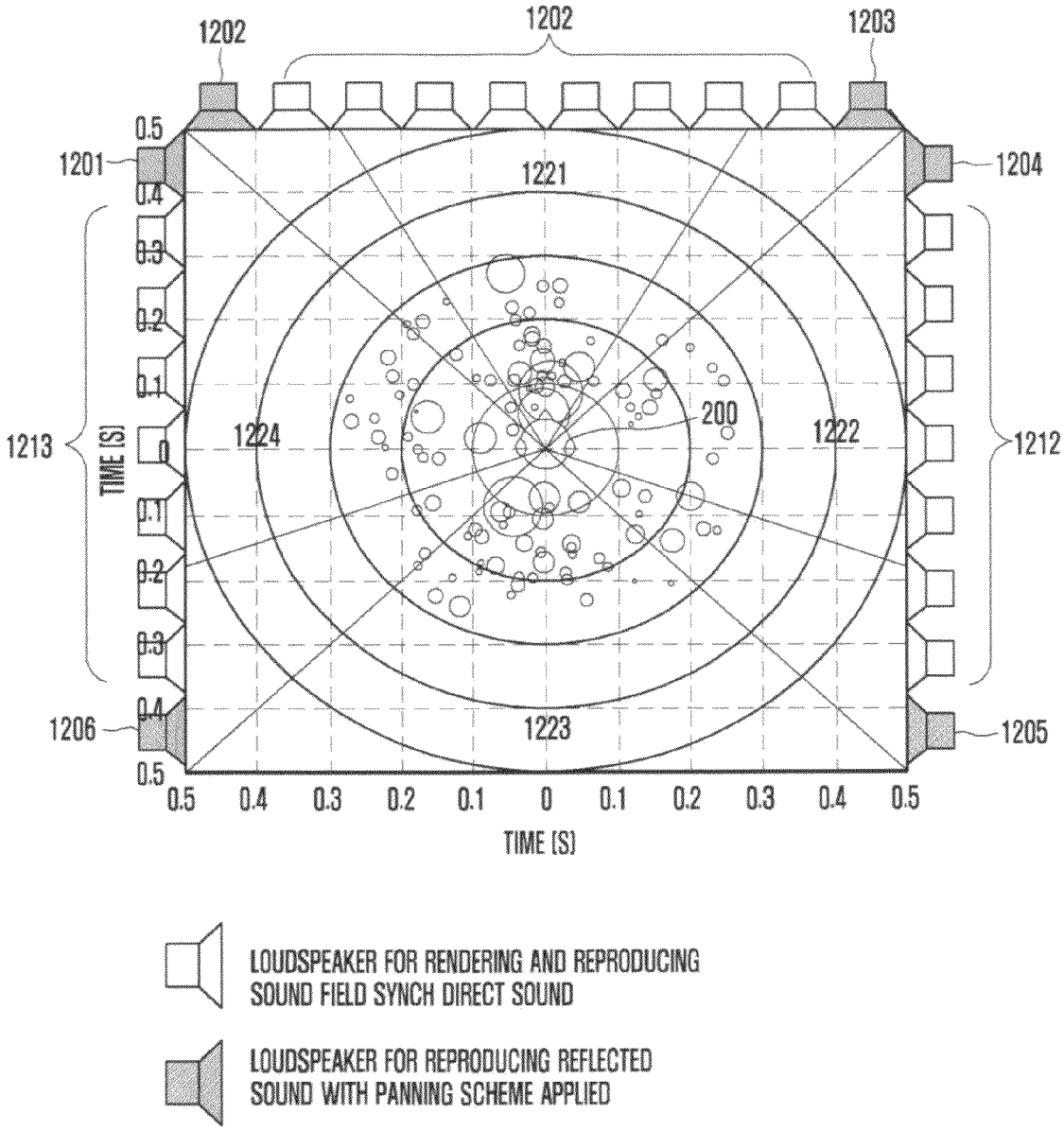

FIGS. 10 to 12 are diagrams illustrating loudspeaker arrangements applied to the first embodiment of the present invention.

As shown in FIG. 10, multichannel loudspeakers are arranged in circle. In this case, the signal processor 820 calculates driving signals for direct sounds based on a wave field synthesis reproduction scheme for the front 1021, the right side 1022, the rear 1023, and the left side 1024 from an audience 200. Then, the reproducer 840 reproduces the driving signals through the loudspeakers 1011 to 1014.

The signal treatment unit 830 localizes reflections at a virtual sound image by analyzing angle components of the calculated reflections signal and allocating the reflection signal to a pair of loudspeakers. That is, the signal treatment unit 830 localizes a reflection signal at a virtual sound image using a pair of loudspeakers among loudspeakers 1001 to 1004 located at 30°, 110°, 250°, and 330° from a listening location. For example, the signal treatment unit 830 localizes a reflection signal of the front 1021 at a virtual sound image using the loudspeaker 1001 at 330° and the loudspeaker at 30°. Also, the signal treatment unit 830 uses the loudspeaker 1002 at 30° and the loudspeaker 1003 at 110° for the right 1022 and the loudspeaker 1001 at 330° and the loudspeaker 1004 at 250° for the left 1024 and localizes reflection signal of each side at virtual sound images in order to reproduce reflections at the sides 1022 and 1024. The signal treatment unit 830 also localizes a reflection signal of the rear at a virtual sound image using the 110° loudspeaker 1003 and the 250° loudspeaker 1004 for reproducing the reflections at the rear 1023.

As shown in FIG. 11, the multichannel loudspeakers are arranged in a rectangle shape. In this case, the signal processor 820 calculates driving signals for a direct sound according to the wave field synthesis reproduction scheme for the front 1121, the right side 1122, the rear 1123, and the left 1124 from the audience 200. Then, the reproducer 840 reproduces the calculated driving signals of each sides corresponding to the loudspeakers 1111 to 1114.

The signal treatment unit 830 localizes reflections at a virtual sound image using two loudspeakers at edges of each array, total eight loudspeakers 1101 to 1108. That is, the signal treatment unit 830 localizes a reflection signal at a virtual sound image using two loudspeakers 1102 and 1103 for the front 1121, two loudspeakers 1104 and 1105 for the right side 1122, two loudspeakers 1106 and 1107 for the rear 1123, and two loudspeakers 1108 and 1101 for the left side 1124.

As shown in FIG. 12, the multichannel loudspeakers may be arranged in a form of '⊏'.. In this case, the signal processor 820 calculates driving signals for a direct sound according to the wave field synthesis reproduction scheme for the front 1221, the right side 1222, the rear 1223, and the left side 1224 based on the audience 200. Then, the reproducer 840 reproduces the calculated driving signal through loudspeakers 1211 to 1213 corresponding to each side.

Meanwhile, the signal treatment unit 830 localizes reflections at a virtual sound image using two loudspeakers at edges of each array, total six loudspeakers 1201 to 1206. That is, the signal treatment unit 830 localizes reflection signal at a virtual sound image using two loudspeakers 1202 and 1203 for the front 1221, two loudspeakers 1204 and 1205 for the right side 1222, two loudspeakers 1025 and 1206 for the rear 1223, and two loudspeakers 1206 and 1201 for the left side 1224.

Meanwhile, the loudspeakers may be arranged in various forms, such as a triangle and a diamond.

Figure 13:
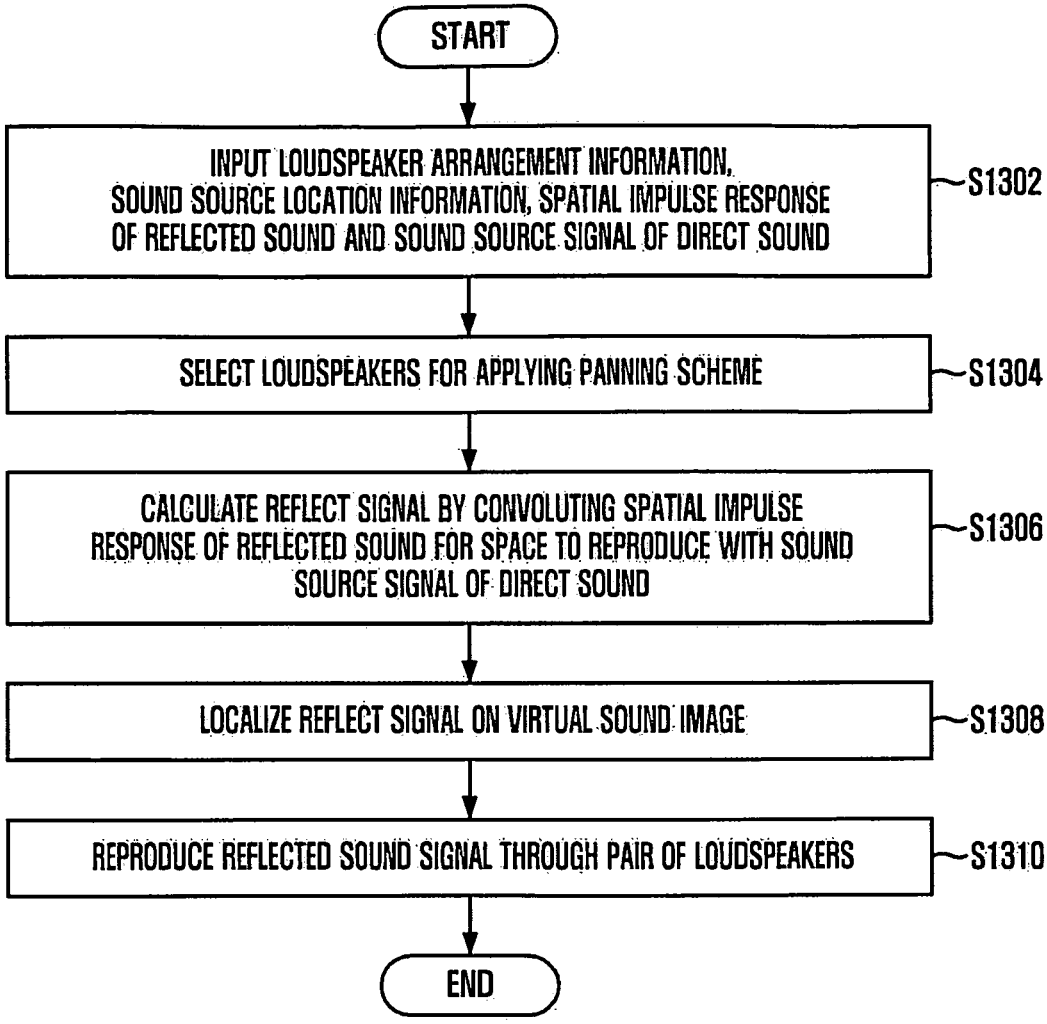
FIG. 13 is a flowchart illustrating a surround sound field reproducing method for reproducing reflections in accordance with a first embodiment of the present invention.

FIG. 13 is a flowchart illustrating a surround sound field reproducing method for reproducing reflections in accordance with a first embodiment of the present invention.

At first, the input unit 810 receives reflection reproducing information at step S1302. The reflection reproducing information includes information about loudspeaker arrangement, a sound source location of reflections for a sound source location to localize from a location of an audience, a spatial impulse response of reflections for a predetermined space to reproduce, and a sound source signal of a direct sound.

The signal processor 820 detects angles of each loudspeaker and distances from an audience to each loudspeaker from the received reflection reproducing information from the input unit 810 and selects loudspeakers to perform a panning algorithm at step S1304. Here, the signal processor 820 selects different loudspeakers according to arrangement types of loudspeakers.

After selecting the loudspeakers for the panning algorithm, the signal processor 820 calculates a reflection signal by convoluting a spatial impulse response of reflections for a predetermined space to reproduce and a sound source signal of a direct sound from the received reflection reproducing information at step S1306.

Then, the signal treatment unit 830 localizes a reflection signal at a virtual sound image by analyzing angle components of the calculated reflections signal from the signal processor 820 and allocating the reflections signal at a pair of loudspeakers. Here, the signal treatment unit 830 localizes the reflections signal at a virtual sound image using the constant power panning law and the inverse square law in order to apply a panning algorithm at step S1308.

The reproducer 840 reproduces the reflections signal localized at the virtual sound image through a pair of loudspeakers at step S1310.

Hereinafter, a surround sound field reproducing apparatus for reproducing reflections according to a second embodiment of the present invention will be described with reference to FIGS. 14 to 18. The surround sound field reproducing apparatus according to the second embodiment relates to a method for individually reproducing each of reflections using a plurality of corresponding loudspeakers.

At first, the surround sound field reproducing apparatus according to the first embodiment will be described again before describing the surround sound field reproducing apparatus according to the second embodiment.

As described above, the surround sound field reproducing apparatus 800 according to the first embodiment can reproduces sounds even at locations where loudspeakers are not physically placed. Therefore, two loudspeakers form a pair in the surround sound field reproducing apparatus 800. The surround sound field reproducing apparatus 800 can reproduce reflections distributed in 360° omnidirection around an audience by reproducing reflections as virtual sound sources using panning between a left speaker 91 and a right speaker 92 for the front, using panning between a left speaker 91 and a left surround speaker 93 for the left side, using panning between a right speaker 92 and the right surround speaker 94 for the right side, and using passing between the left surround speaker 93 and the right surround speaker 94 for the rear.

In the surround sound field reproducing apparatus 800, a virtual sound image may incline to speakers although the constant power panning law is applied. Here, a sound image cannot be accurately localized due to the virtual sound image inclined to the speakers. Also, a sound tone may be changed due to power control or power combination.

Therefore, the surround sound field reproducing apparatus 1400 according to the second embodiment uses previously disposed loudspeaker arrays to reproduce a reflection signal surrounding an audience in a 360° omnidirection. Here, the reflections signal has a time of reproducing a reflection signal after a direct sound is reproduced, a sound pressure, and an incline angle from an audience. That is, since the reflections signal has three information to reproduce as shown in Table 1, the surround sound field reproducing apparatus 1400 according to the second embodiment allocates reflection signal to each of loudspeakers and reproduces the reflection signal through corresponding loudspeakers using angle information among three information of the reflections signal. Since the loudspeakers surrounds an audience, the surround sound field reproducing apparatus 1400 directly reproduces reflections at loudspeakers at an incline angle without rendering. Such a method is referred as a grouped reflection algorithm.

Figure 14:
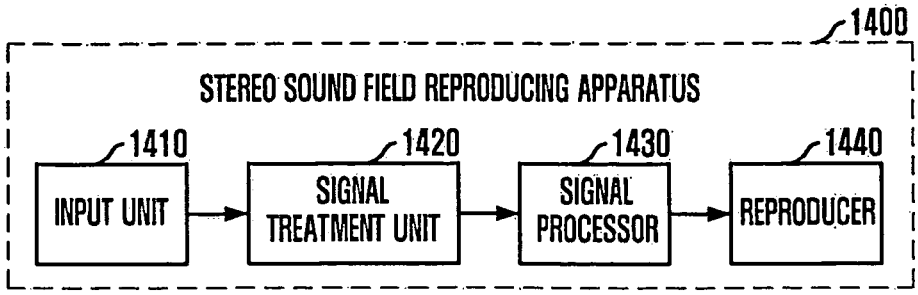
FIG. 14 is a block diagram illustrating a surround sound field reproducing apparatus according to a second embodiment of the present invention.

FIG. 14 is a block diagram illustrating a surround sound field reproducing apparatus according to a second embodiment of the present invention.

Referring to FIG. 14, the surround sound field reproducing apparatus 1400 according to the second embodiment includes an input unit 1410, a signal treatment unit 1420, a signal processor 1430, and a reproducer 1440.

The input unit 1410 receives information about loudspeaker arrangement, information about a sound source location of reflections for a sound source location to localize from an location of an audience, a spatial impulse response of reflections for a predetermined space to reproduce, and a sound source signal of a direct sound.

The signal treatment unit 1420 calculates angles of each loudspeaker and distances from each loudspeaker to a location of each reflections to reproduce by analyzing the received loudspeaker arrangement information and the received information about a sound source location of reflections for a sound source location to localize from a location of an audience. Then, the signal treatment unit 1420 confirms loudspeakers corresponding to reproducing angles of reflections using the calculated reproducing angles of each loudspeaker and the calculated distances between each loudspeaker and the sound source locations of reflections.

Here, a process of confirming loudspeakers corresponding to the reproducing angles of the reflections will be described.

It is assumed that a circular loudspeaker array is formed by placing a plurality of loudspeakers at a regular interval with the same distance to an audience sustained. That is, a loudspeaker is located at the front of an audience at 0° from the audience. Next loudspeaker is located k° separated from the previous loudspeaker in a clockwise. The audience is located at the center of the circular loudspeaker array. And, all distances from each loudspeaker to the audience is the same.

The signal treatment unit 1420 compares a loudspeaker reproducing angle with reflection reproducing angle, which is k° or times of k°, by analyzing a sound source location and an angle of reflections. Then, the signal treatment unit 1420 determines the reflection reproducing angle is what times of k°. Finally, the signal treatment unit 1420 selects a loudspeaker related to the determined times of k°. Here, if the reflection reproducing angle is not times of k°, the signal treatment unit 1420 selects one having smaller angle difference than the other from adjacent loudspeakers based on the reproducing angle of the reflections.

And, the signal treatment unit 1420 controls at least one of an angle and power of the received spatial impulse response of reflections for a predetermined space to reproduce, received from the input unit 1410 according to the angle times of each loudspeaker and a distance from each loudspeaker to a sound source location of reflections.

The signal processor 1430 calculates reflection signal to be allocated to each of loudspeakers by convoluting the controlled spatial impulse response from the signal treatment unit 1420 and the received sound source signal of a direct sound.

The reproducer 1440 reproduces the calculated reflection signal from the signal processor 1430 through the loudspeakers selected by the signal treatment unit 1420.

Figure 15:
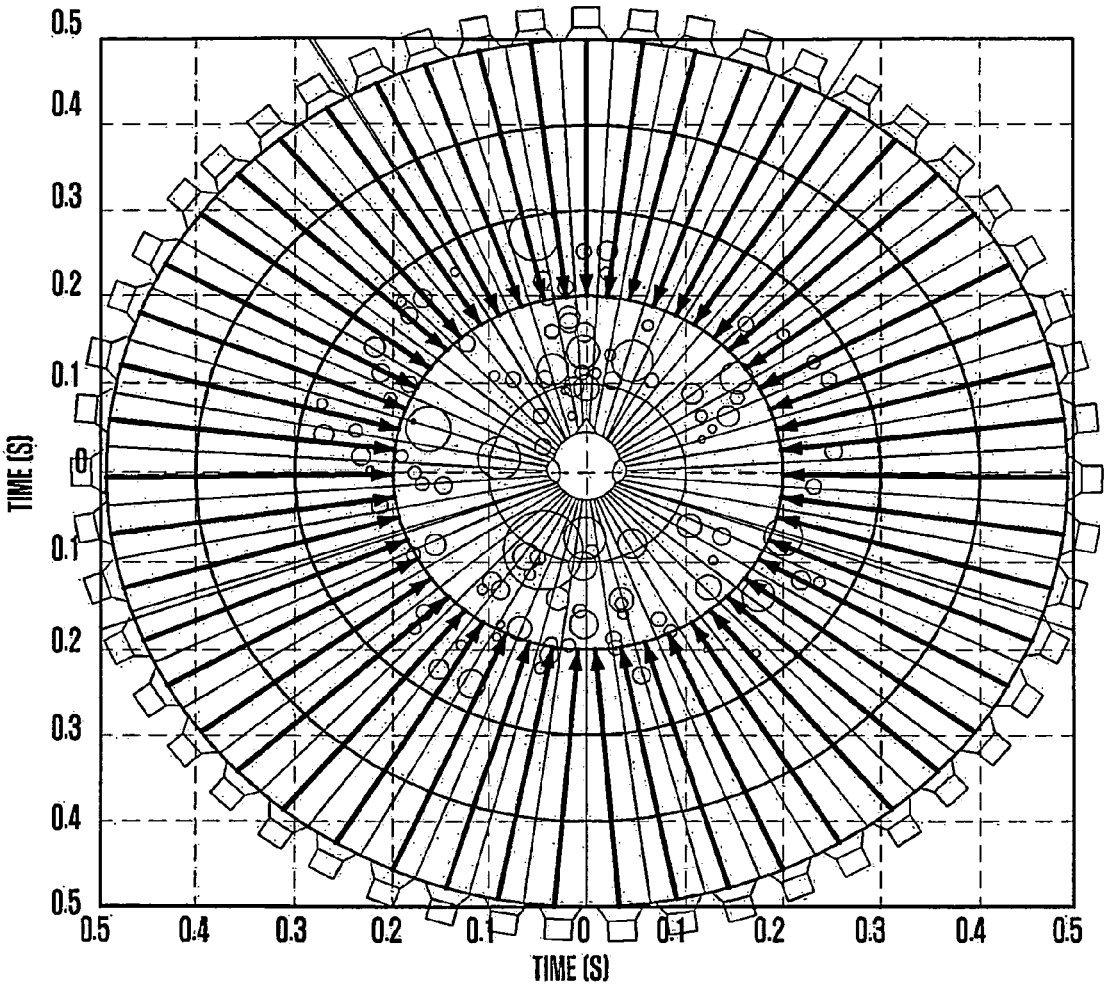
Figure 16:
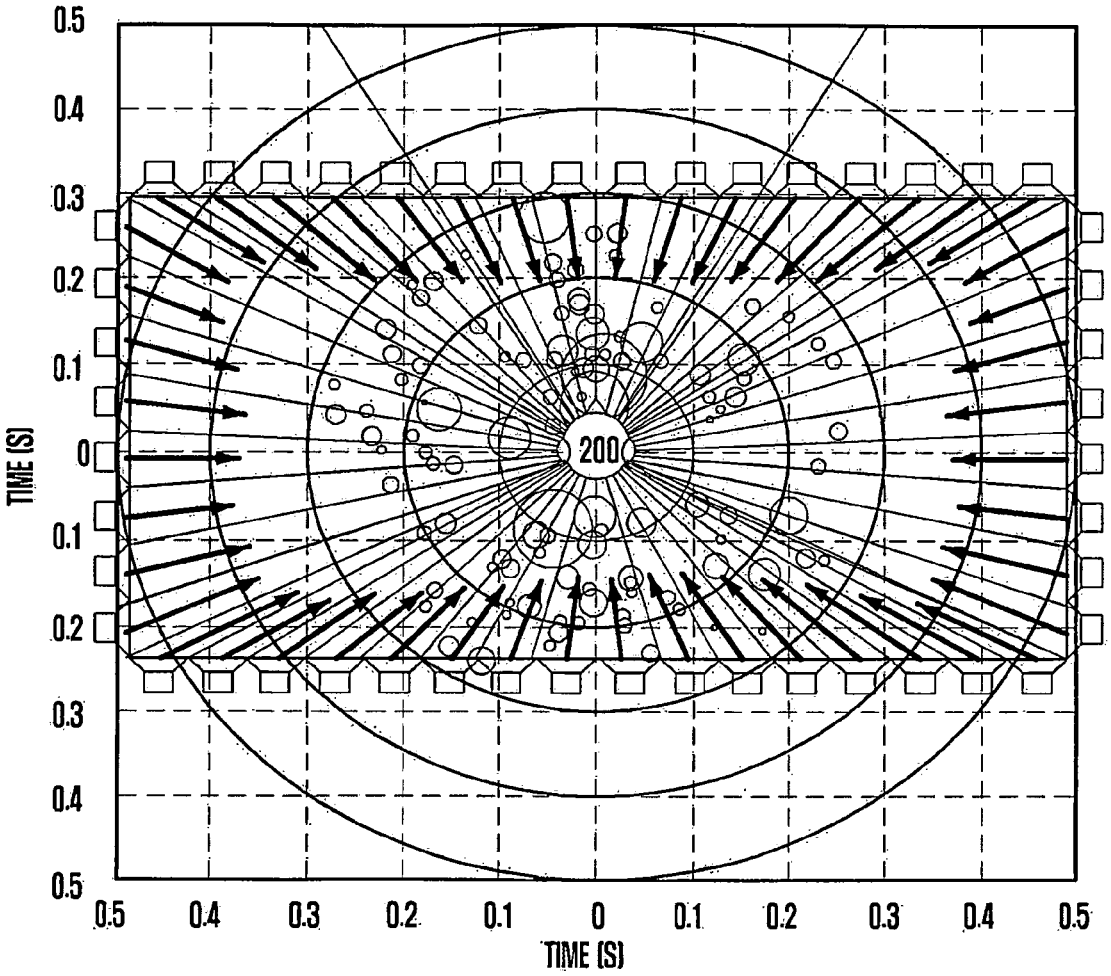
Figure 17:
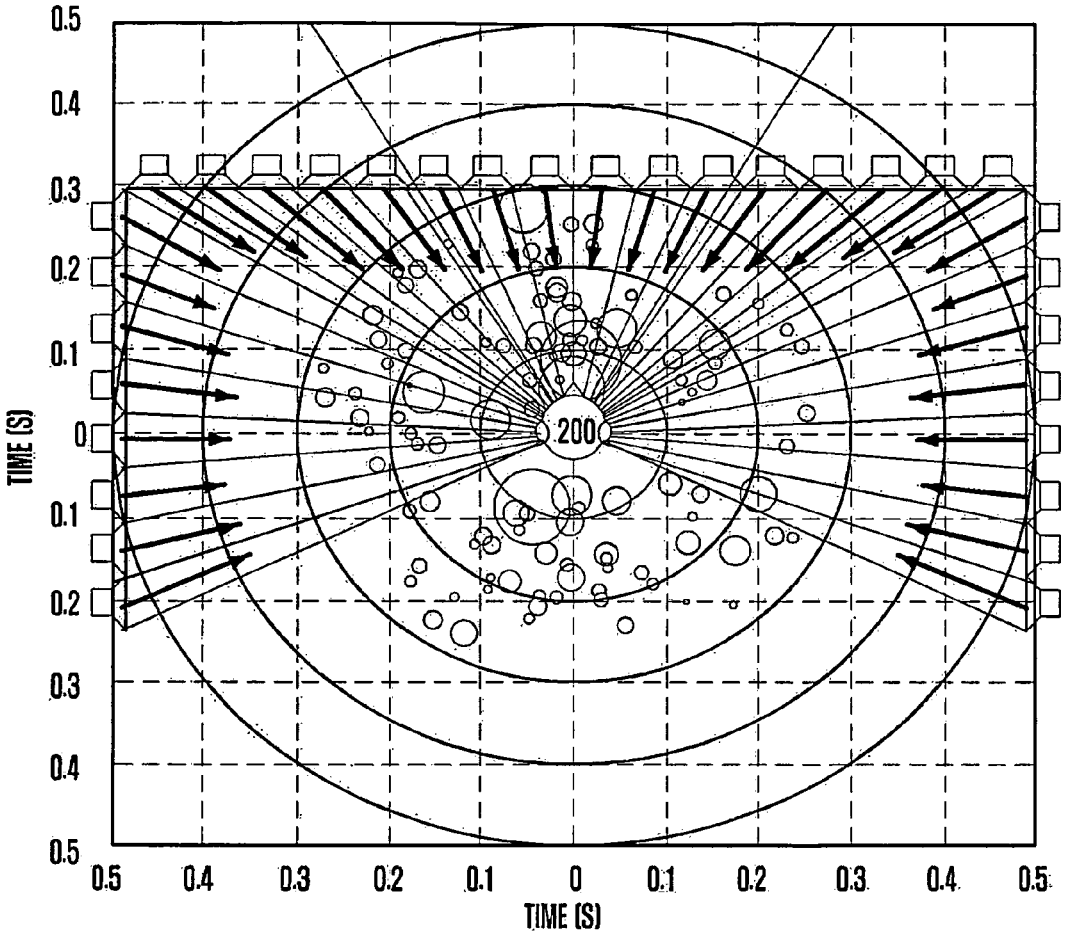

FIGS. 15 to 17 are diagrams illustrating loudspeaker arrangements where the second embodiment of the present invention is applied to.

Referring to FIG. 15, loudspeakers are arranged in circle. An audience 200 is located at the center thereof and loudspeakers are disposed at every k° separated from a previous loudspeaker. The distances between each loudspeaker and the audience are the same.

As described above, the signal treatment unit 1420 determines whether an angle of reflections is k° or times of k° by analyzing information about the angle of a sound source location of reflections. Here, the signal treatment unit 1420 decides one closer than the other from adjacent angles to the angle of the reflections which is not corresponding to k° or times of k°.

As shown in FIG. 16, the loudspeakers may be disposed in a rectangular formation. In FIG. 15, the distances between each loudspeaker and an audience are the same because the audience is located at the center of the circular loudspeaker array. However, distances from each loudspeaker to an audience are not the same in the rectangular loudspeaker array, as shown in FIG. 16.

As shown in FIG. 17, loudspeakers may be arranged in a form of ' ⊏ ' in the surround sound field reproducing apparatus according to the second embodiment.

For the surround sound field reproducing apparatus according to the second embodiment, loudspeakers may be arranged in various formations such as a triangle and a diamond. The listening location of the audience 200 may lean toward a predetermined side. Therefore, sound pressures can be re-controlled per each angle of a reflection signal based on the loudspeaker arrangement information and the sound source location information.

Figure 18:
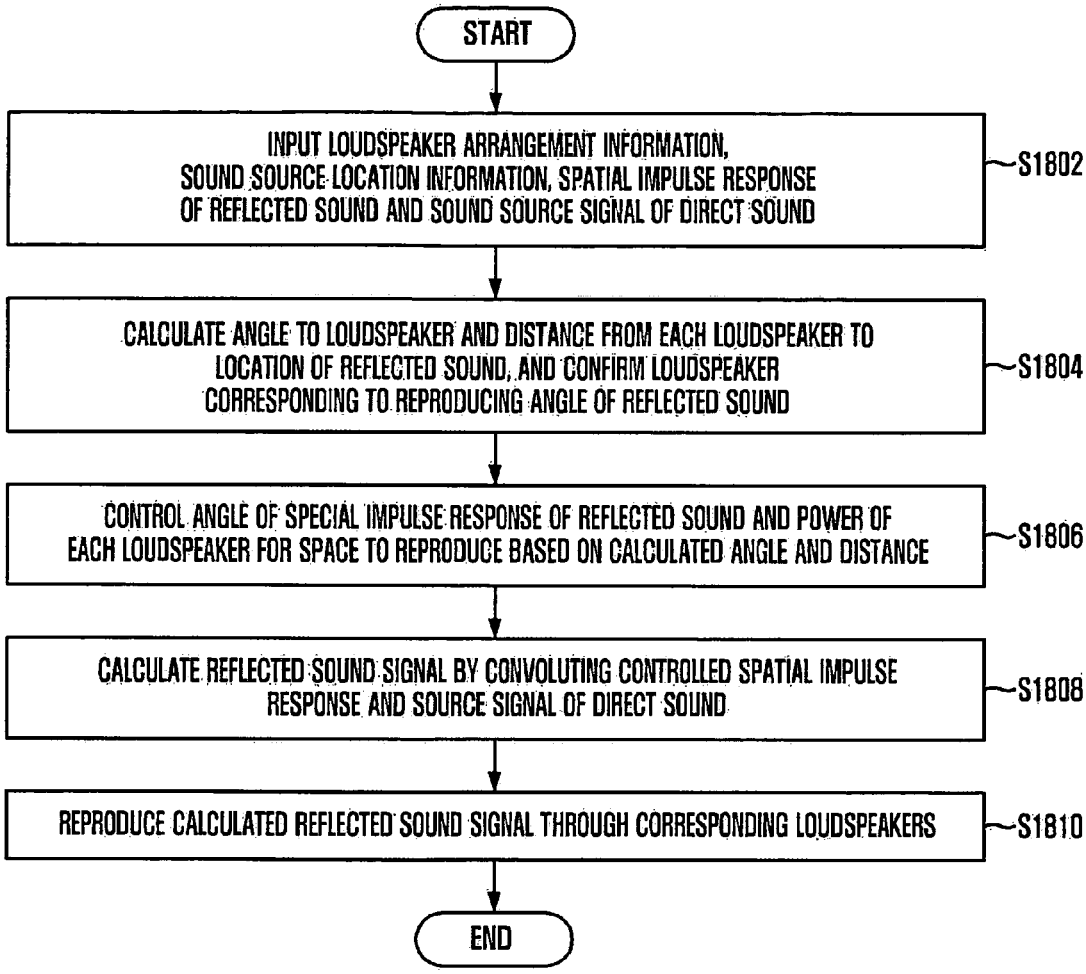
FIG. 18 is a flowchart illustrating a surround sound field reproducing method for reproducing reflections in accordance with a second embodiment of the present invention.

FIG. 18 is a flowchart illustrating a surround sound field reproducing method for reproducing reflections in accordance with a second embodiment of the present invention.

At first, the input unit 1410 receives information about loudspeaker arrangement, information about a sound source location of reflections for a sound source location to localize from a location of an audience, a spatial impulse response of reflections for a space to produce, and a sound source signal of a direct sound at step S1802.

Then, the signal treatment unit 1420 calculates angles of each loudspeaker from adjacent loudspeaker and distances from each loudspeaker to a location of reflections to reproduce by analyzing the received loudspeaker arrangement information and the received information about a sound source location of reflections for a sound source location to localize from a location of an audience. Then, the signal treatment unit 1420 confirms a loudspeaker corresponding to a reproducing angle of reflections using the reproducing angles of each loudspeaker and the distances between each of loudspeakers and a sound source location of reflections at step S1804.

The signal treatment unit 1420 controls at least one of an angle and power of a spatial impulse response of reflections for a predetermined space to reproduce, which from the input unit 1410, according to the angle of each loudspeaker and the distance between each loudspeaker to a sound source location of reflections at step S1806. Here, if the reproducing angle of reflections is not times of k°, the signal treatment unit 1420 decides one having smaller angle difference between adjacent loudspeakers based on the reproducing angle of reflections.

The signal processor 1430 calculates a reflection signal to allocate to each of the loudspeakers by convoluting the controlled spatial impulse response with an sound source signal of a direct sound received at the input unit 1410 at step S1808.

Then, the reproducer 1440 reproduces the calculated reflection signal from the signal processor 1430 through loudspeakers confirmed by the signal treatment unit 1420 at step S1810.

As described above, the technology of the present invention can be realized as a program and stored in a computer-readable recording medium, such as CD-ROM, RAM, ROM, floppy disk, hard disk and magneto-optical disk. Since the process can be easily implemented by those skilled in the art of the present invention, further description will not be provided herein.

While the present invention has been described with respect to certain preferred embodiments, it will be apparent to those skilled in the art that various changes and modifications may be made without departing from the spirits and scope of the invention as defined in the following claims As described above, the sound field reproducing apparatus according to the present invention provides realistic presence and space perception to audiences by reproducing reflections using a panning algorithm or individually reproducing corresponding reflections using each of loudspeakers while producing not only a direct sound but also the reflections through multichannel loudspeaker array.

That is, the sound field reproducing apparatus according to the present invention reproduces the direct sound according to the wave field synthesis reproducing scheme, not both of the reflections and the direct sound, and reproduce the reflections using the panning algorithm. Therefore, computation amount and time can be reduced, and the reflections can be efficiently reproduced in a view of power because loudspeakers are selectively driven. Furthermore, since the reflections is reproduced using each of loudspeakers, a rendering process is not necessary for reproducing the reflections and a computation amount and time can be reduced too. Moreover, it is possible to prevent sound tone variation which may be caused by the rendering process for reproducing the reflections.

What is claimed is:

1. A surround sound field reproducing apparatus, comprising:

an input means for receiving reflection reproducing information;

a signal processing means for selecting loudspeakers and calculating reflection signal for applying a panning algorithm based on the reflection reproducing information;

a signal treatment means for localizing the calculated reflection signal on a virtual sound image according to the panning algorithm, wherein the signal treatment means allocates a reflection signal to two loudspeakers selected by the signal processing means from among a plurality of loudspeakers, and the signal treatment means arranges a virtual sound image between the two loudspeakers by controlling the output power of the two speakers in accordance with the panning algorithm; and a reproducing means for reproducing the localized reflection signal through the selected loudspeakers by panning between the two loudspeakers to which the reflection signal is allocated.

2. The surround sound field reproducing apparatus of claim 1, wherein the signal treatment means allocates the calculated reflection signal to the two loudspeakers by analyzing angle components of the calculated reflection signal to localize the calculated reflection signal at the virtual sound image.

3. The surround sound field reproducing apparatus of claim 2, wherein the signal treatment means uses a constant power panning law to use the two loudspeakers and an inverse square law to correct a virtual sound image according to a distance to localize the calculated reflection signal at the virtual sound image.

4. The surround sound field reproducing apparatus of claim 1, wherein the input means receives loudspeaker arrangement information, sound source location information of reflections, a spatial impulse response of reflections, and a sound source signal of a direct sound, and the signal processing means selects a plurality of loudspeakers for applying the panning algorithm based on the received loudspeaker arrangement information and the received sound source location information, and calculates the reflection signal by convoluting the received spatial impulse response of the reflections and the received sound source signal of the direct sound.

5. The surround sound field reproducing apparatus of claim 4, wherein the signal processing means selects the loudspeakers for applying the panning algorithm by confirming angles and distances between the sound source location of the reflections and each loudspeaker from the received loudspeaker arrangement information and the received sound source location information.

6. The surround sound field reproducing apparatus of claim 5, wherein the signal processing means selects different loudspeakers according to an arrangement type of the loudspeakers to apply the panning algorithm.

7. A surround sound field reproducing apparatus, comprising:

an input means for receiving reflection reproducing information;

a signal treatment means for confirming loudspeakers corresponding to reflection reproducing angles based on the received reflection reproducing information and controlling spatial impulse responses of reflections according to the confirmed loudspeakers;

a signal processing means for calculating reflection signal from the controlled spatial impulse responses and a sound source signal of a direct sound; and a reproducing means for reproducing the calculated reflection signal through the confirmed loudspeakers, wherein the signal treatment means compares loudspeaker reproducing angles, which are predetermined multiples of a predetermined angle, with reflection reproducing angles, determines which multiple of the predetermined angle the reflection reproducing angle is, and selects a loudspeaker corresponding to the determined multiple of the predetermined angle.

8. The surround sound field reproducing apparatus of claim 7, wherein the input means receives loudspeaker arrangement information, sound source location information of reflections, spatial impulse responses of reflections, and a sound source signal of a direct sound, and the signal treatment means confirms the loudspeakers corresponding to reflection reproducing angles based on the received loudspeaker arrangement information and the received sound source location information, and controls the received spatial impulse responses according to the confirmed loudspeakers.

9. The surround sound field reproducing apparatus of claim 8, wherein the signal treatment means confirms the loudspeakers corresponding to loudspeaker reproducing angles, which are calculated based on the received loudspeaker arrangement information and the received sound source location information, and reflection reproducing angles, which are calculated based on distances between each of the loudspeakers and a sound source of reflections.

10. The surround sound field reproducing apparatus of claim 9, wherein, when the reflection reproducing angle does not correspond to a multiple of the predetermined angle, the signal treatment means selects a multiple of the predetermined angle from among adjacent multiples of the predetermined angle which has a smallest angle difference based on the reflection reproducing angle.

11. The surround sound field reproducing apparatus of claim 10, wherein the signal treatment means controls an angle or power for the spatial impulse response of the reflections corresponding to the confirmed loudspeaker.

12. A surround sound field reproducing method, comprising the steps of:

receiving reflection reproducing information;

selecting loudspeakers and calculating reflection signal for applying a panning algorithm based on the reflection reproducing information;

localizing the calculated reflection signal on a virtual sound image according to the panning algorithm, wherein a reflection signal is allocated to two loudspeakers selected from among a plurality of loudspeakers, and the virtual sound image is arranged between the two loudspeakers by controlling the output power of the two speakers in accordance with the panning algorithm; and reproducing the localized reflection signals through the selected loudspeakers by panning between the two loudspeakers to which the reflection signal is allocated.

13. The surround sound field reproducing method of claim 12, wherein in the localizing the calculated reflection signal, the calculated reflection signal are allocated to the two loudspeakers by analyzing angle components of the calculated reflection signal to localize the calculated reflection signal at the virtual sound image.

14. The surround sound field reproducing method of claim 13, wherein the localizing the calculated reflection signal, the calculated reflection signal are localized at the virtual sound image using a constant power panning law to use the two loudspeakers and an inverse square law to correct a virtual sound image according to a distance.

15. The surround sound field reproducing method of claim 12, wherein in the receiving reflection reproducing information, loudspeaker arrangement information, sound source location information of reflections, a spatial impulse response of reflections, and a sound source signal of a direct sound are received; and in the selecting loudspeakers and calculating reflection signal, a plurality of loudspeakers for applying the panning algorithm are selected based on the received loudspeaker arrangement information and the received sound source location information, and the reflection signal are calculated by convoluting the received spatial impulse response of the reflections and the received sound source signal of the direct sound.

16. The surround sound field reproducing method of claim 15, wherein in the selecting loudspeakers and calculating reflection signal, the loudspeakers for applying the panning algorithm are selected by confirming angles and distances between the sound source location of the reflections and each loudspeaker from the received loudspeaker arrangement information and the received sound source location information.

17. The surround sound field reproducing method of claim 16, wherein in the selecting loudspeakers and calculating reflection signal, different loudspeakers are selected according to an arrangement type of the loudspeakers to apply the panning algorithm.

18. A surround sound field reproducing method, comprising the steps of:

receiving reflection reproducing information;

confirming loudspeakers corresponding to reflection reproducing angles based on the received reflection reproducing information and controlling spatial impulse responses of reflections according to the confirmed loudspeakers;

calculating reflection signal from the controlled spatial impulse responses and a sound source signal of a direct sound; and reproducing the calculated reflection signal through the confirmed loudspeakers, wherein in the confirming loudspeakers corresponding to reflection reproducing angles, reflection reproducing angles are compared with loudspeaker reproducing angles, which are predetermined multiples of a predetermined angle, it is determined which multiple of the predetermined angle the reflection reproducing angle is and a loudspeaker corresponding to the determined multiple of the predetermined angle is selected.

19. The surround sound field reproducing apparatus of claim 18, wherein in the receiving reflection reproducing information, loudspeaker arrangement information, sound source location information of reflections, spatial impulse responses of reflections, and a sound source signal of a direct sound are received; and the loudspeakers are confirmed corresponding to reflection reproducing angles based on the received loudspeaker arrangement information and the received sound source location information, and the received spatial impulse responses are controlled according to the confirmed loudspeakers.

20. The surround sound field reproducing method of claim 19, wherein in the confirming loudspeakers corresponding to reflection reproducing angles, the loudspeakers are confirmed corresponding to loudspeaker reproducing angles, which are calculated based on the received loudspeaker arrangement information and the received sound source location information, and reflection reproducing angles, which are calculated based on distances between each of the loudspeakers and a sound source of reflections.

21. The surround sound field reproducing method of claim 20, wherein in the confirming loudspeakers corresponding to reflection reproducing angles, when the reflection reproducing angle does not correspond to a multiple of the predetermined angle, a multiple of the predetermined angle from among adjacent multiples of the predetermined angle having a smallest angle difference based on the reflection reproducing angle is selected.

22. The surround sound field reproducing apparatus of claim 21, wherein in the confirming loudspeakers corresponding to reflection reproducing angles, an angle or power for the spatial impulse response of the reflections is controlled corresponding to the confirmed loudspeaker.

* * * * *